US006559400B2

(12) United States Patent
Hayashi

(10) Patent No.: US 6,559,400 B2
(45) Date of Patent: May 6, 2003

(54) SWITCH STRUCTURE FOR CAR ELECTRICAL PART

(75) Inventor: Hiroyuki Hayashi, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/003,087

(22) Filed: Dec. 6, 2001

(65) Prior Publication Data

US 2002/0092755 A1 Jul. 18, 2002

(30) Foreign Application Priority Data

Dec. 25, 2000 (JP) ..... 2000-392159

(51) Int. Cl.[7] ..... H01H 15/06
(52) U.S. Cl. ..... 200/550; 200/549
(58) Field of Search ..... 200/537–541, 200/549, 550, 547, 548, 519, 16 A, 16 C, 16 D, 16 R; 362/549, 487–488; 439/404, 188

(56) References Cited

U.S. PATENT DOCUMENTS 5,722,850 A * 3/1998 White ..... 439/404
5,984,736 A * 11/1999 Sakurai et al. ..... 439/738
6,076,947 A * 6/2000 Miller ..... 362/492
6,267,616 B1 * 7/2001 Sakatani et al. ..... 439/404
6,325,526 B1 * 12/2001 Yabata et al. ..... 200/550

FOREIGN PATENT DOCUMENTS

| | | | |
|---|---|---|---|
| GB | 1 147 447 | | 4/1969 |
| JP | 09-171744 | A | 6/1997 |
| JP | 09-171744 | * | 6/1997 |

* cited by examiner

*Primary Examiner*—Elvin Enad
*Assistant Examiner*—M. Fishman
(74) *Attorney, Agent, or Firm*—Oliff & Berridge, PLC

(57) ABSTRACT

In a switch structure for a car electrical part, on the guide rail 11C of a base member 11, there are disposed the respective contact portions 12A, 14A of terminal members 12, 14 in such a manner that they have a given position relationship, and, in the first side 15A of a movable contact piece 15 disposed so as to be slidable on the guide rail 11C, there are formed two contact portions 15E which extend perpendicular to the sliding direction of the movable contact piece 15 and can be contacted selectively with the two contact portions 12A and 14A. Also, in the second side 15B of the movable contact piece 15, there is formed a plate-spring-shaped portion 15G which can be engaged with uneven portions 11F formed in the second surface 11B of the base member 11 to thereby generate a click feeling.

5 Claims, 4 Drawing Sheets

SWITCH STRUCTURE FOR CAR ELECTRICAL PART

BACKGROUND OF THE INVENTION

1. Field of the Invention

The present invention relates to a switch structure for a car electrical part such as a lamp unit to be mounted on the ceiling portion of a car room.

2. Description of the Related Art

As known well, on the ceiling portion of a car room, there are mounted electrical parts such as a room lamp and a map lamp. Also, on a door trim, there are mounted electrical parts such as a switch for a power window and a foot lamp.

Description will be given below of a switch structure used in a conventional electrical part for use in a car with reference to FIGS. 3 and 4A to 4C. FIG. 3 is an exploded perspective view of a conventional switch structure. FIG. 4A is a plan view of the conventional switch structure, showing its switch-off state, FIG. 4B is a section view thereof, showing its switch-off state, and FIG. 4C is a section view thereof, showing its switch-on state.

As shown in FIGS. 3 and 4A to 4C, in the conventional switch structure, terminal members 2, 3 and 4, which are respectively connected to a function member (not shown) such as a light bulb holder, are disposed and held at given positions on a base member 1 which is formed of insulating resin. In the two end portions of each of the two terminal members 2, there are formed a wire connecting portion 2B, into which an insulated covered wire can be pressure inserted, and a tongue-shaped contact portion 2A for contact with a movable contact piece 5. In the two ends of the terminal member 3 forming part of the light bulb holder, there are respectively formed a wire connecting portion 3A and a plate-spring-shaped portion (not shown). Similarly, in the two ends of the terminal member 4 forming part of the light bulb holder, there are respectively formed a contact portion 4A for contact with the movable contact piece 5 and a bent portion (not shown) A light bulb (not shown) is held by and between the plate-spring-shaped portion of the terminal member 3 and the bent portion of the terminal member 4.

The movable contact piece 5 has a substantially-U-shaped section, can be fitted with a guide rail 1C formed in the vicinity of one end of the base member 1, and is able to slide on the guide rail 1C. Also, in the movable contact piece 5, there is formed a plate-spring-shaped contact portion 5A which can be selectively contacted with a portion between the contact portion 2A of one terminal member 2 and the contact portion 4A of the terminal member 4, only the contact portion 4A of the terminal member 4, and a portion between the contact portion 2A of the other terminal member 2 and the contact portion 4A of the terminal member 4; and, on the contact portion 5A, there is provided a projection 5B which is used to generate a click feeling. Also, in the guide rail 1C as well as in the contact portions 2A, 4A of the terminal members 2, 4, there are formed uneven portions which can be engaged with the projection 5B. The movable contact piece 5 can be engaged with a switch operation knob (not shown) and thus can be slid between the above respective contact positions in response to the movement of the switch operation knob.

As known well, since there is formed a fit clearance between the movable contact piece 5 and the guide rail 1C of the base member 1, in the conventional switch structure for a car electrical part, in order not only to be able to absorb the rickety motion of the movable contact piece 5 caused by the fit clearance but also to be able to secure a given contact pressure between the contact portion 5A of the movable contact piece 5 and the contact portions 2A, 4A of the respective terminal members 2, 4, the contact portion 5A is formed in a plate-spring-like shape and also there is formed the projection 5B used to generate a click feeling. However, because the contact portion 5A and projection 5B are disposed in one and the same portion, in case where the switch operation knob is operated, there is a possibility that, in the above fit clearance portion, the movable contact piece 5 can be rotated about the projection 5*b* in the axial direction of the movable contact piece 5. In case where the movable contact piece 5 is rotated about the projection 5*b*, there is raised a possibility that the contact portion 5A cannot be properly contacted with the contact portions 2A, 4A of the respective terminal members 2, 4, which results in the poor contact between them. Also, there are raised another possibilities: that is, the edge portions 5C of the movable contact piece 5 can be contacted with the guide rail 1C of the base member 1 to thereby cut the base member 1 and thus produce resin chips; and, the sliding resistance of the movable contact piece 5 can be increased to thereby degrade the operation feeling of the switch operation knob accordingly.

SUMMARY OF THE INVENTION

The present invention aims at solving the above-mentioned problems found in the conventional structure. Accordingly, it is an object of the invention to provide a switch structure for a car electrical part which not only can reduce the possibility of poor contact occurring between the terminal members and movable contact piece but also can provide an excellent switch operation feeling.

In attaining the above object, according to the invention, there is provided a switch structure for a car electrical part comprises: two or more terminal members each having one end connected to a function member or a wire member and the other end serving as a terminal-side contact portion; a movable contact piece contactable selectively with the terminal-side contact portions to thereby form a switch; and, a base member including a terminal hold portion for arranging and holding the terminal members thereon in such a manner that the terminal-side contact portions have a given position relationship, and a guide rail portion which can be engaged with and holds the movable contact piece in such a manner that the movable contact piece is able to slide in a given direction, wherein the movable contact piece includes two contact-piece-side contact portions disposed perpendicular to the sliding direction of the movable contact piece for contact with the terminal-side contact portions, and a spring portion which, when it is elastically deformed, can be contacted with the guide rail portion of the base member and, due to its elastic force, can generate a given contact force between the contact-piece-side contact portions and terminal-side contact portions.

In the above switch structure, preferably, in part of the spring portion of the movable piece, there may be disposed a projection and, in the portion of the guide rail portion of the base member on which the spring portion of the movable contact piece is slidable, there may be disposed an uneven portion engageable with the projection of the spring portion in order that the contact-piece-side contact portions and the terminal-side contact portions can be contacted with each other in a given selective state.

Also, preferably, the spring portion of the movable contact piece may be contacted with a different surface of the base member from the surface thereof that holds the terminal members thereon.

Further, preferably, the movable contact piece may be structured such that: a section thereof in a direction perpendicular to the sliding direction of the movable contact piece has a substantially U-like shape; in one of two sides thereof forming a substantially U-like shape and opposed to each other, there are disposed the above-mentioned contact-piece-side contact portions; and, in the other side, there is disposed the above-mentioned plate-spring-shaped portion.

In addition, preferably, at least one of the above-mentioned contact-piece-side contact portions and the above-mentioned plate-spring-shaped portion may be disposed at a position distant from the operation point of the operation force applied to the movable contact piece.

DETAILED DESCRIPTION OF THE PREFERRED EMBODIMENTS

Figures 1A, 1B, 1C:
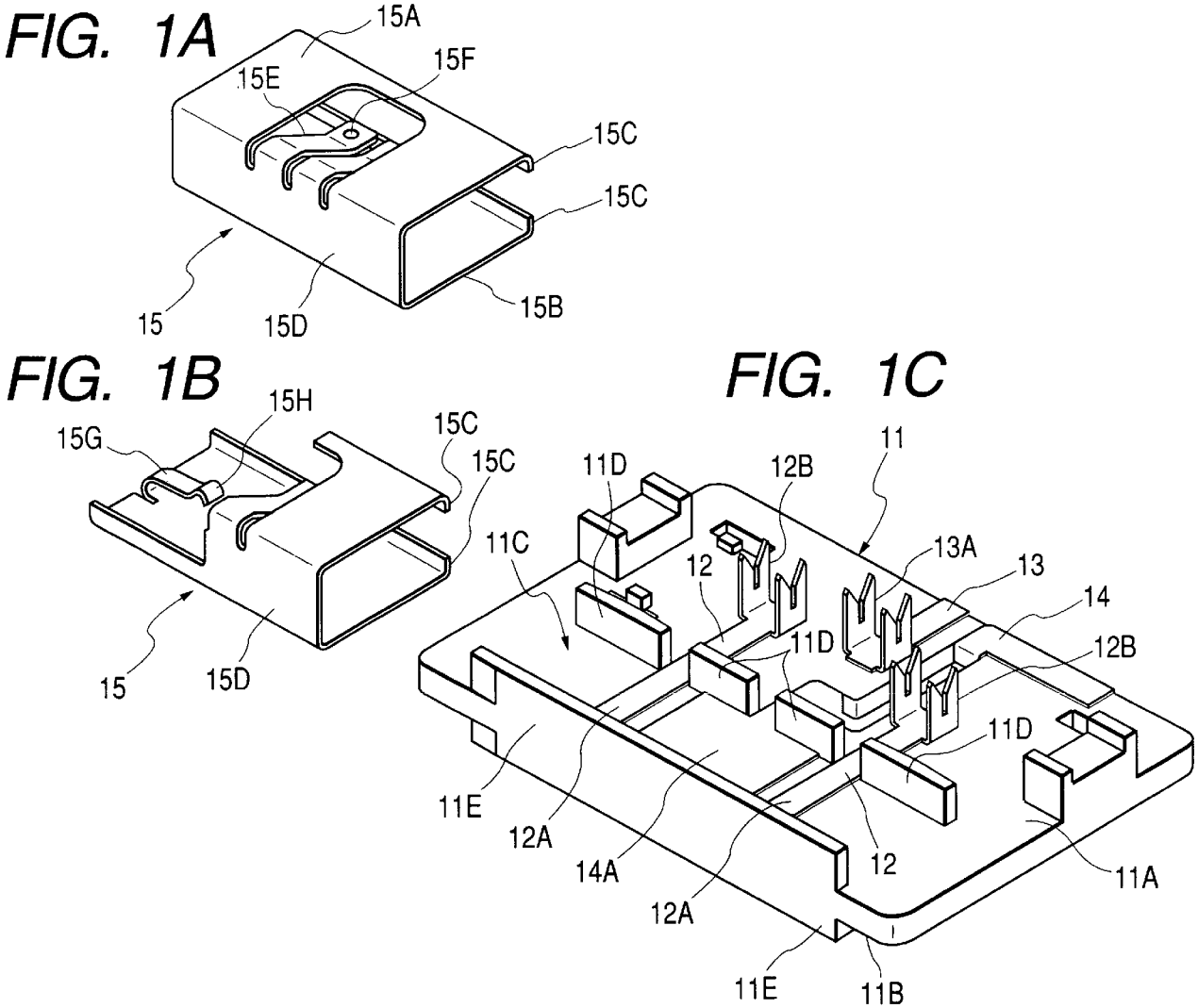
FIGS. 1A to 1C are exploded perspective views of a switch structure for a car electrical part according to an embodiment of the invention.
Figures 2A, 2B, 2C:
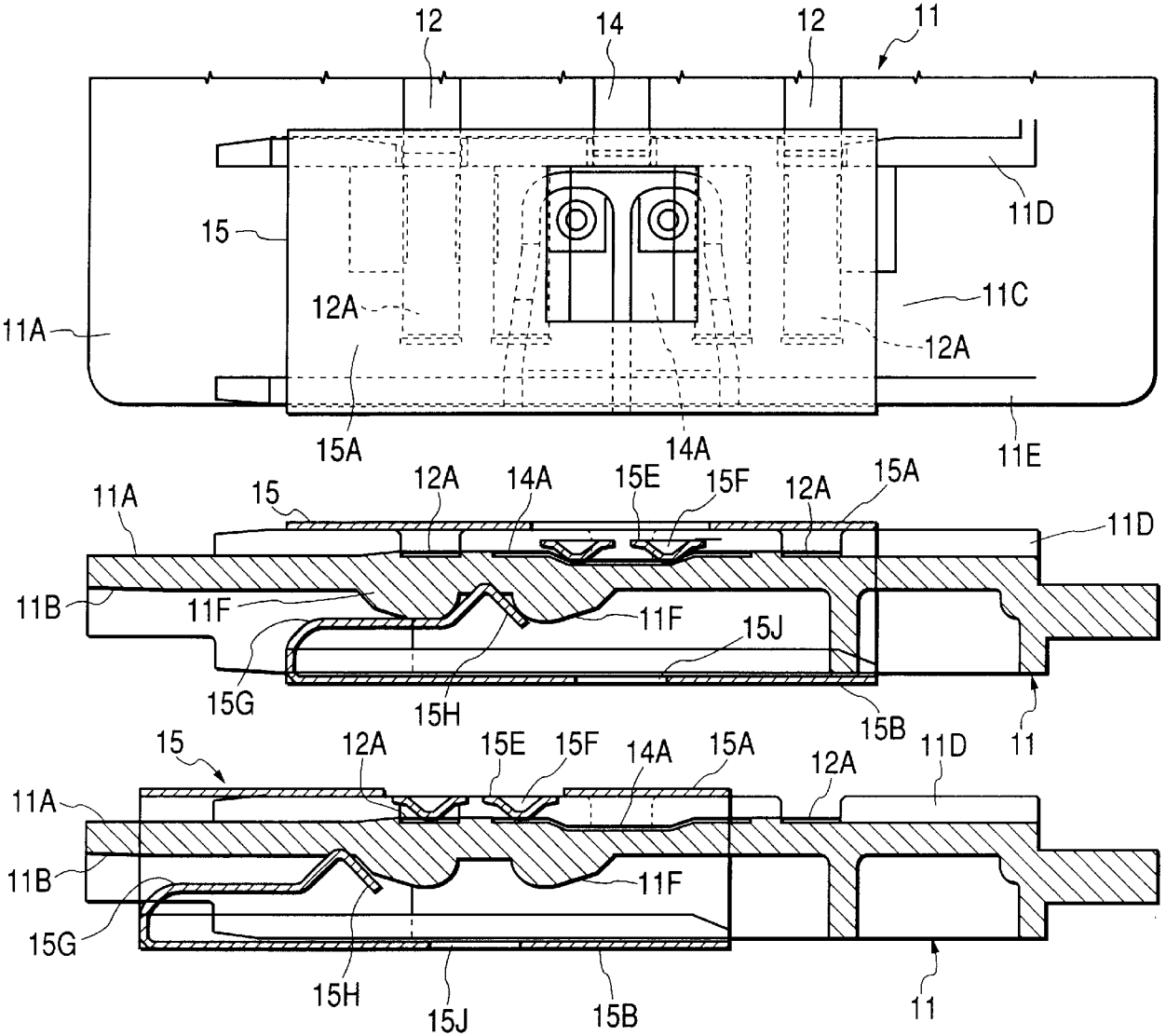
FIGS. 2A to 2C are section views showing a state thereof in which a movable contact piece is fitted with and mounted on a base member according to the embodiment.
Figure 3:
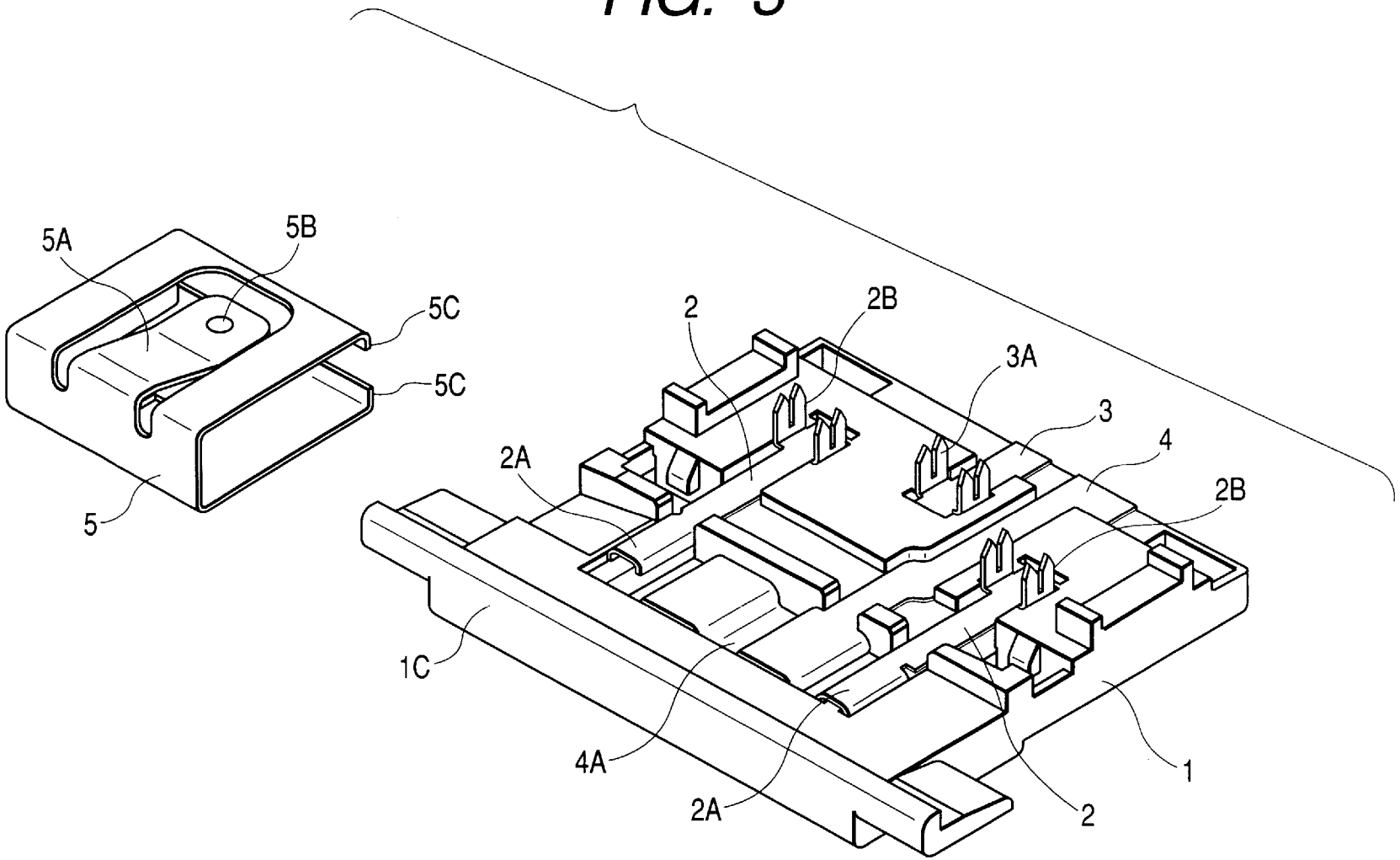
FIG. 3 is an exploded perspective view of a conventional switch structure for a car electrical part.
Figure 4A:
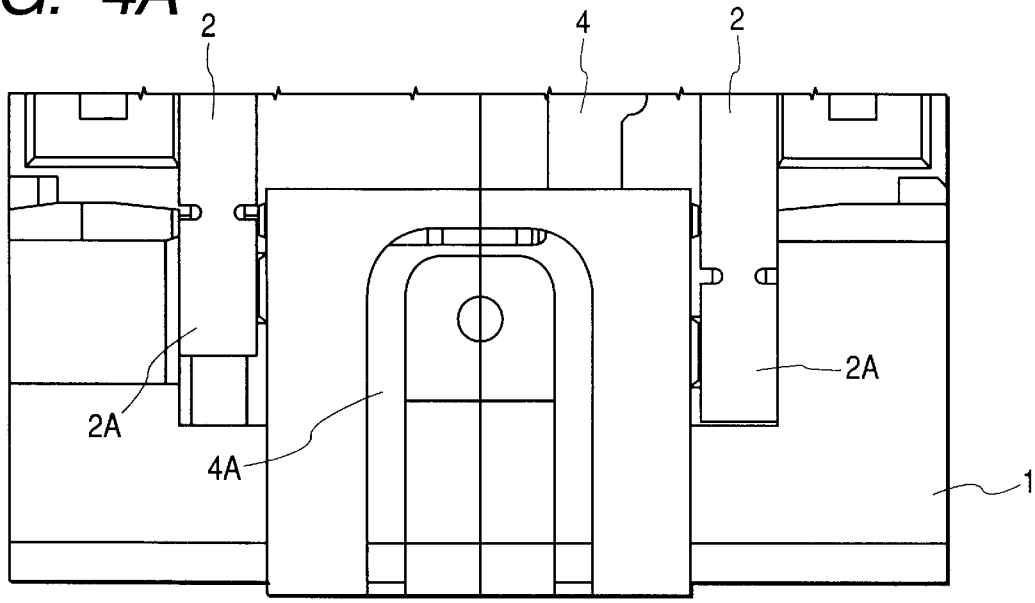
FIGS. 4A to 4C are section views of the conventional switch structure for a car electrical part, showing a state thereof in which a movable contact piece is fitted with and mounted on a base member.
Figure 4B:
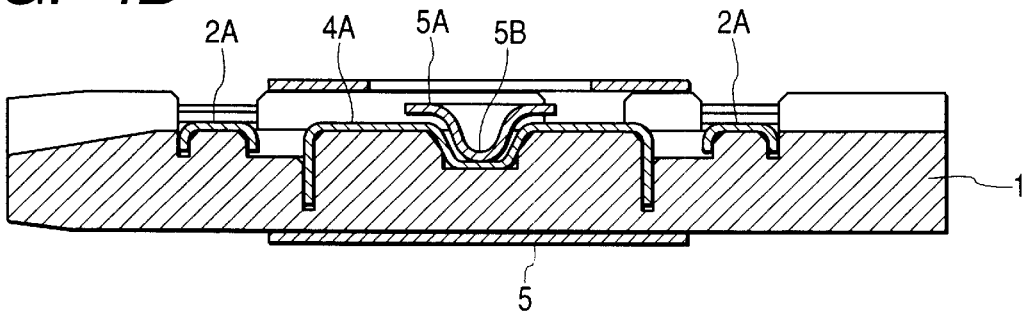
Figure 4C:
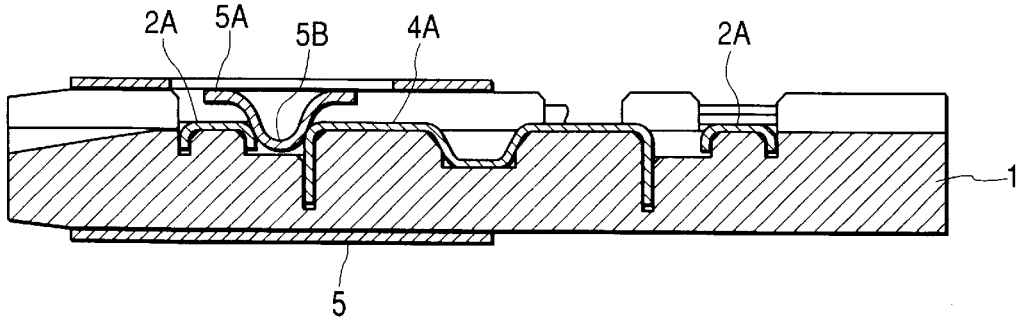

Now, description will be given below of an embodiment of a switch structure for a car electrical part according to the invention with reference to the accompanying drawings. FIGS. 1A to 1C are exploded perspective views of a switch structure according to the present embodiment: Specifically, FIG. 1A is a perspective view of the external shape of a movable contact piece used in the present structure; FIG. 1B is a partially broken view of the movable contact piece; and FIG. 1C is a perspective view of a base member, showing a state in which terminal members are fitted with and mounted on the base member. Also, FIGS. 2A to 2C are schematic views of the present switch structure, showing a state thereof in which the movable contact piece is fitted with and mounted on a base member: Specifically, FIG. 2A is a plan view of the switch structure held in a switch-off state; FIG. 2B is a section view thereof held in a switch-off state; and, FIG. 2C is a section view thereof held in a switch-on state.

As shown in FIGS. 1A to 1C and 2A to 2C, in the switch structure according to the present embodiment, similarly to the conventional switch structure, for example, terminal members 12, 13, 14, which are respectively connected to a function member (not shown) such as a light bulb holder, are disposed and held at their given positions on a base member 11 formed of insulating resin. In the two end portions of each of the two terminal members 12, there are formed a wire connecting portion 12B, into which an insulated covered wire can be pressure inserted, and a tongue-shaped contact portion 12A for contact with a movable contact piece 15. In the two ends of the terminal member 13 forming part of the light bulb holder, there are respectively formed a wire connecting portion 13A and a plate-spring-shaped portion (not shown). Similarly, in the two ends of the terminal member 14 forming part of the light bulb holder, there are respectively formed a contact portion 14A for contact with the movable contact piece 15 and a bent portion (not shown) However, differently from the above conventional switch structure, the surface of the contact portion 12A of the terminal member 12 and the surface of the contact portion 14A of the terminal member 14 are respectively substantially flat and not so uneven as in the conventional structure. Also, a light bulb (not shown) is held by and between the plate-spring-shaped portion of the terminal member 13 and the bent portion of the terminal member 14.

In the vicinity of one end of the base member 11, there is formed a guide rail 11C with which the movable contact piece 15 can be fitted and also on which the movable contact piece 15 is able to slide. The guide rail 11C is composed of guide walls 11D, 11E which extend substantially perpendicularly to the first surface (front surface) 11A and second surface (back surface) 11B of the base member 11 and are opposed to each other; that is, the guide rail 11C is formed in a channel-like shape (or is formed so as to have a substantially H-shaped section). The channel-shaped bottom surface of the guide rail 11C on the first surface 11A side is flat and is flush with the first surface 11A. Also, the guide wall 11D on the first surface 11A side is divided into a plurality of sections in order that terminal members 12, 14 can be fitted with and mounted on the guidewall 11D. On the other hand, in the channel-shaped bottom surface of the guide rail 11C on the second surface 11B side, there are formed uneven portions 11F which can be contacted with the plate-spring-shaped portion 15G of the movable contact piece 15 (which will be discussed later) and, due to the deformation and restoration of the plate-spring-shaped portion 15G, can generate a click feeling (see FIGS. 2B and 2C).

The movable contact piece 15 is structured such that its section in a direction perpendicular to the sliding direction of the movable contact piece 15 has a substantially U-like shape; and, the edge portions 15C of the movable contact piece 15 and the vertical side 15D thereof having a substantially U-like shape are respectively fitted with the outer sides of the guide walls 11D, 11E of the guide rail 11C. Also, on a first side (upper side) 15A of the two sides of the movable contact piece 15 which cooperate together in forming a substantially U-like shape and extend in parallel to each other, there are disposed two plate-spring-shaped contact portions 15E which can be selectively contacted with a portion between the contact portion 12A of one terminal member 12 and the contact portion 14A of the terminal member 14, only the contact portion 14A of the terminal member 14, and a portion between the contact portion 12A of the other terminal member 12 and the contact portion 14A of the terminal member 14; and also, the two plate-spring-shaped contact portions 15E are disposed perpendicular to the sliding direction of the movable contact piece 15 and, on each of the two contact portions 15E, there is provided a projection 15F (see FIG. 1A). On the other hand, on a second side (lower side) 15A of the mutually parallel two sides, there is formed a plate-spring-shaped portion 15G which is bent in the sliding direction of the movable contact piece 15 (see FIG. 1B). Also, in the vicinity of the leading end portion of the plate-spring-shaped portion 15G, there is provided a projection 15H which can be engaged with the uneven portions 11F formed in the guide rail 11C on the second surface 11B side of the base member 11. By the way, substantially in the central portion of the second side 15B of the movable contact piece 15, there is formed an engagement hole 15J with which a switch operation knob (not shown) can be engaged; and thus, due to the engagement hole 15J, the movable contact piece 15 is able to slide between the above-mentioned respective contact positions according to the movement of the switch operation knob.

In the switch-off state shown in FIG. 2B, since the two contact portions 15E (projections 15F) of the movable contact piece 15 are both in contact with the contact portion 14A of the terminal member 14, the function member such as a light bulb is not energized electrically. To change this switch-off state over to such a switch-on state as shown in FIG. 2C, the switch operation knob may be operated to thereby move the movable contact piece 15 to the left in FIGS. 2A to 2C. In case where an operation force is applied to the movable contact piece 15, with the movement of the movable contact piece 15, the plate-spring-shaped portion 15G is deformed and thus the projection 15H is allowed to go beyond the uneven portion 11F of the base member 11. In case where the projection 15H goes beyond the uneven portion 11F completely, the plate-spring-shaped portion 15G is restored to its original shape due to its own elasticity. In this case, when the projection 15H is contacted with the second surface 11B of the base member 11, there is produced a click sound or a shock, which allows an operator to recognize that the state of the switch has been changed over.

In this case, the operation force is applied to the engagement hole 15 portion of the movable contact piece 15; and, since there is formed the fit clearance between the movable contact piece 15 and the guide rail 11C of the base member 11, depending on the direction of the operation force, the moment to rotate the movable contact piece 15 in this fit clearance portion can be applied to the engagement hole 15 portion. However, the movable contact piece 15 is in contact with the base member 11 and terminal members 12, 14 held on the base member 11 at the three points thereof, namely, the projections 15F of the two contact portions 15E and the projection 15H of the plate-spring-shaped portion 15G. Also, while the two contact portions 15E are situated just above the engagement hole 15J, the plate-spring-shaped portion 15G is disposed at a position distant from the contact portions 15E and engagement hole 15J. Therefore, in case where the moment to rotate the movable contact piece 15 is applied to the engagement hole 15 portion and the movable contact piece 15 is thereby going to rotate about either of the two contact portions 15E or about a middle point between them, a frictional force, which is caused in the contact portion between the projection 15H of the plate-spring-shaped portion 15G and the second surface 11B of the base member 11, acts as a reaction force against the rotational force of the movable contact piece 15. As described above, because the plate-spring-shaped portion 15G is distant from the contact portions 15E, the moment going in the opposite direction to the moment of rotation becomes very large, which makes it difficult for the movable contact piece 15 to rotate.

By the way, in the illustrated embodiment, one unit of the plate-spring-shaped portion 15G is disposed in the sliding direction of the movable contact piece 15. However, the invention is not limited to this but two units of the plate-spring-shaped portion 15G maybe disposed in the sliding direction of the movable contact piece 15 in such a manner that they are symmetric with respect to the center of the movable contact piece 15. Also, the contact portions 15E of the movable contact piece 15 are disposed above the engagement hole 15J to be engaged with the switch operation knob, but this is not limitative: that is, the contact portions 15E or the engagement hole 15J may also be disposed in other portions.

As has been described hereto, the switch structure for a car electrical part according to the invention comprises: two or more terminal members each having one end connected to a function member or a wire member and the other end serving as a terminal-side contact portion; a movable contact piece contactable selectively with the terminal-side contact portions to thereby form a switch; and, a base member including a terminal hold portion for arranging and holding the terminal members thereon in such a manner that the terminal-side contact portions have a given position relationship, and a guide rail portion which can be engaged with and can hold the movable contact piece in such a manner that the movable contact piece is able to slide in a given direction, wherein the movable contact piece includes two contact-piece-side contact portions disposed perpendicular to the sliding direction of the movable contact piece for contact with the terminal-side contact portions, and a spring portion which, when it is elastically deformed, can be contacted with the guide rail portion of the base member and, due to its elastic force, can generate a given contact force between the contact-piece-side contact portions and terminal-side contact portions.

That is, according to this structure, the movable contact piece is contacted with the base member and terminal members held on the base member at at least three points due to its spring portion. Therefore, in moving the movable contact piece, even in case where a force to rotate the movable contact piece about any one of the three points is applied to the movable contact piece, frictional forces acting on the other two points serve as resistance to the rotational force to thereby try to prevent the rotation of the movable contact piece. Due to this, there are reduced not only the possibility that there can occur poor contact between the contact-piece-side contact portions of the movable contact piece and the terminal-side contact portions of the terminal members, but also the possibility that the edge portions of the movable contact piece can be contacted with the guide rail portion of the base member; and thus, the possibility that the resin chips of the base member can be produced as well as the possibility that the sliding resistance of the movable contact piece can be increased can be reduced to a great extent. Further, there is little possibility that the operation feeling of the switch operation knob can be degraded. As a result of this, there can be supplied a switch structure for car electrical parts which can reduce the possibility that poor contact can occur between the terminal members and movable contact piece and is also excellent in the switch operation feeling.

Also, in part of the spring portion of the movable piece, there is disposed a projection and, in the portion of the guide rail portion of the base member on which the spring portion of the movable contact piece is slidable, there are disposed uneven portions engageable with the projection of the spring portion in order that the contact-piece-side contact portions and the terminal-side contact portions can be contacted with each other in a given selective state. Thanks to this structure, when moving the movable contact piece, the uneven portions of the base member provide an obstacle to the movement of the movable contact piece and thus, to move the movable contact piece, the spring portion of the movable piece must be deformed to such a degree that the it can move beyond the uneven portion. This can prevent the possibility that the contacted condition between the contact-piece-side contact portions and the terminal-side contact portions can be shifted unexpectedly. Also, the force applied when deforming the spring portion as well as the shock occurring when the spring portion is deformed to go beyond the uneven portion and is then restored to its original shape generate a proper click feeling, thereby being able to convey the change-over of the state of the switch to an operator through his or her hand feeling.

Further, the spring portion of the movable contact piece is contacted with a different surface of the base member from the surface thereof that holds the terminal members thereon. Thanks to this, since the movable contact piece is contacted with the guide rail portion of the base member in such a manner that the former holds or sandwiches the latter from both the side of the latter holding the terminal members and the rear side thereof, the movable contact piece is able to slide along the guide rail portion more smoothly.

Moreover, the movable contact piece is structured such that: a section thereof in a direction perpendicular to the sliding direction of the movable contact piece has a substantially U-like shape; in one of two sides thereof forming a substantially U-like shape and opposed to each other, there are disposed the above-mentioned contact-piece-side contact portions; and, in the other side, there is disposed the above-mentioned plate-spring-shaped portion. Thanks to this, the movable contact piece can be formed integrally by pressing and can also be reduced in size.

In addition, at least one of the above-mentioned contact-piece-side contact portions and the above-mentioned plate-spring-shaped portion are disposed at a position distant from the operation point of the operation force applied to the movable contact piece. Due to this, a frictional force acting on a position distant from the operation point of the operation force acts as a reaction force against a force to rotate the movable contact piece, and the moment of the frictional force increases. As a result of this, the movable contact piece is made hard to rotate.

What is claimed is:

1. A switch structure for a car electrical part, comprising:

two or more terminal members each having one end connected to a function member or a wire member and the other end serving as a terminal-side contact portion;

a movable contact piece contactable selectively with said terminal-side contact portions to thereby form a switch; and a base member including a terminal hold portion for arranging and holding said terminal members thereon in such a manner that said terminal-side contact portions have a given position relationship, and, a guide rail portion to be engageable with and hold said movable contact piece in such a manner that said movable contact piece is able to slide in a given direction;

wherein said movable contact piece includes two contact-piece-side contact portions disposed perpendicular to the sliding direction of said movable contact piece for contact with said terminal-side contact portions, and a spring portion which, when it is elastically deformed, is in contact with said guide rail portion of said base member and, due to its elastic force, generates a given contact force between said contact-piece-side contact portions and said terminal-side contact portions.

2. The switch structure for a car electrical part as set forth in claim 1, wherein, in part of said spring portion, there is disposed a projection and, in the portion of said guide rail portion of said base member on which said spring portion of said movable contact piece is slidable, there is disposed an uneven portion engageable with said projection of said spring portion in order that said contact-piece-side contact portions and said terminal-side contact portions are in contact with each other in a given selective state.

3. The switch structure for a car electrical part as set forth in claim 1, wherein said spring portion of said movable contact piece can be contacted with a different surface of said base member from the surface thereof that holds said terminal members thereon.

4. The switch structure for a car electrical part as set forth in claim 3, wherein said movable contact piece is structured such that: a section thereof in a direction perpendicular to the sliding direction of said movable contact piece has a substantially U-like shape; in one of two sides thereof cooperating together in forming a substantially-like shape and opposed to each other, there are disposed said contact-piece-side contact portions; and, in the other side, there is disposed said plate-spring-shaped portion.

5. A switch structure for a car electrical part as set forth in claim 4, wherein at least one of said contact-piece-side contact portions and said plate-spring-shaped portion are disposed at a position distant from the operation point of an operation force applied to said movable contact piece.

* * * * *